US006561843B1

(12) United States Patent
Ma et al.

(10) Patent No.: US 6,561,843 B1
(45) Date of Patent: May 13, 2003

(54) FPC CONNECTOR

(75) Inventors: Hao-Yun Ma, Tu-Chen (TW); Hsiang-Ping Chen, Tu-Chen (TW); Chaw-Chung Cheng, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,291

(22) Filed: Dec. 26, 2001

(30) Foreign Application Priority Data

Nov. 16, 2001 (TW) ..... 9021986 U

(51) Int. Cl.[7] ..... H01R 9/07
(52) U.S. Cl. ..... 439/495; 439/326
(58) Field of Search ..... 439/495, 492, 439/493, 496, 326, 327

(56) References Cited

U.S. PATENT DOCUMENTS 4,629,271 A * 12/1986 Awano ..... 339/75
5,639,260 A * 6/1997 McHugh ..... 439/495
5,871,369 A * 2/1999 Obayashi et al. ..... 439/495

* cited by examiner

*Primary Examiner*—P. Austin Bradley
*Assistant Examiner*—Alexander Gilman
(74) *Attorney, Agent, or Firm*—Wei Te Chung

(57) ABSTRACT

An FPC (Flexible Printed Circuit) connector includes a housing defining a central slot and conductive contacts having opposite branches retained in the housing on opposite sides of the central slot. A stuffer bar is received in the central slot and is movable between a withdrawn position and an engaged position. The stuffer bar has finger grips on opposite ends thereof for being gripped by fingers of a user to apply a driving force to move the stuffer bar with respect to the housing. The stuffer bar has a flat surface on which a flexible circuit is positioned whereby when the stuffer bar is moved to the engaged position, a normal force is applied by the flat surface of the stuffer bar to the flexible circuit for engaging a conductive pattern of the flexible circuit with the corresponding contacts. A recess is formed in a middle portion of the flat surface of the stuffer bar whereby the middle portion of the stuffer bar is free of normal force acting upon the flexible circuit. The total force acting upon the flexible circuit is divided into two components acting on opposite sides of the recess and located close to the finger grips thereby reducing moments induced by the driving force. Damage caused by undue deformation of the stuffer bar is thus alleviated.

1 Claim, 5 Drawing Sheets

FPC CONNECTOR

BACKGROUND OF THE INVENTION

1. Field of the Invention

The present invention generally relates to the field of electrical connectors and more particular to an electrical connector for connecting a Flexible Printed Circuit (FPC).

2. The Related Arts

An FPC (Flexible Printed Circuit) connector connects a flexible printed circuit to a regular printed circuit board. The FPC connector comprises a housing defining a central slot and conductive contacts retained in the housing with opposite branches thereof arranged on opposite sides of the slot. The housing is mounted to a printed circuit board and the contacts are soldered to the printed circuit board. A stuffer bar is partially and movably received in the slot. The stuffer bar has a flat face on which an end of a flexible circuit is positioned. The stuffer bar is then moved further into the slot of the housing, securely fit between the opposite branches of the contacts. This applies a normal force to the flexible circuit, driving the flexible circuit against the contacts thereby engaging conductive pattern of the flexible circuit with the contacts. The stuffer bar must be mechanically strong to stand friction force induced by the normal force between the flat face thereof and the flexible circuit in order to properly move with respect to the housing. An example is shown in U.S. Pat. No. 5,308,262.

With the miniaturization of electronic parts, the stuffer bar is made smaller and thinner, while the number of contacts of the FPC connector in a given length is increased. The increased number of contacts leads to large friction. Thus a greater driving force is required for moving the stuffer bar into/out of the slot to engage/disengage the flexible circuit with/from the contacts. In moving the stuffer bar our of the slot, such a large friction force may make a central portion of the stuffer bar stuck in the connector housing, while opposite end portions of the stuffer bar that are gripped by fingers of a user are moved outward already. This bends the stuffer bar and may eventually break the stuffer bar.

In addition, in moving the stuffer bar and the flexible circuit into the housing of the connector, such a great force may prevent the stuffer bar from being correctly inserted into the slot. Thus, proper engagement between the conductive pattern of the flexible circuit and the contacts of the connector may not be obtained.

Further, such a situation can be worse with the dimension of the stuffer bar reduced. The thinner the stuffer bar is, the worse the situation can be.

It is thus desirable to provide an FPC connector with a modified stuffer bar to overcome the above problems.

SUMMARY OF THE INVENTION

Accordingly, an object of the present invention is to provide an FPC connector comprising a stuffer bar requiring less insertion force.

Another object of the present invention is to provide an FPC connector comprising a stuffer bar capable to alleviate undesired deformation thereof during engagement with and/or disengagement from a flexible circuit.

To achieve the above objects, an FPC (Flexible Printed Circuit) connector constructed in accordance with the present invention comprises a housing defining a central slot and conductive contacts having opposite branches retained in the housing on opposite sides of the central slot. A stuffer bar is received in the central slot and is movable between a withdrawn position and an engaged position. The stuffer bar has finger grips on opposite ends thereof for being gripped by fingers of a user to apply a driving force to move the stuffer bar with respect to the housing. The stuffer bar has a flat surface on which a flexible circuit is positioned whereby when the stuffer bar is moved to the engaged position, a normal force is applied by the flat surface of the stuffer bar to the flexible circuit for engaging a conductive pattern of the flexible circuit with the corresponding contacts. A recess is formed in a middle portion of the flat surface of the stuffer bar whereby the middle portion of the stuffer bar is free of normal force acting upon the flexible circuit. The total force acting upon the flexible circuit is divided into two components acting on opposite sides of the recess and located close to the finger grips thereby reducing moments induced by the driving force. Damage caused by undue deformation of the stuffer bar is thus alleviated.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
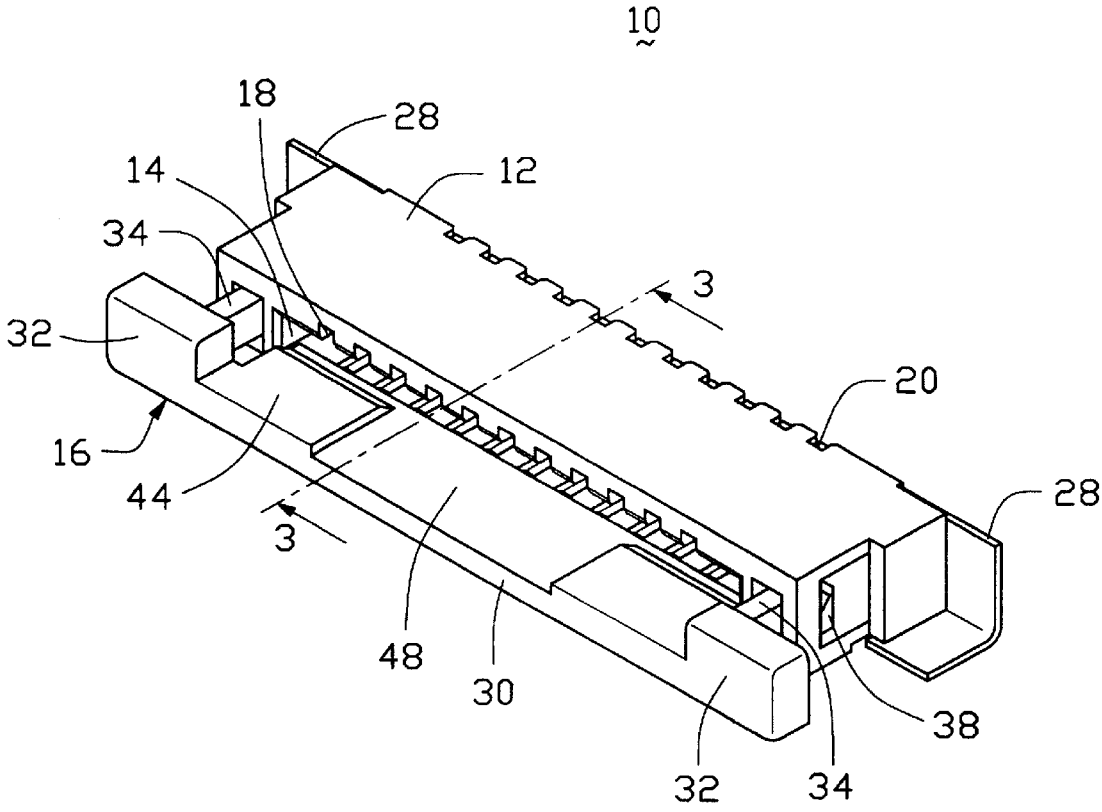
FIG. 1 is a perspective view of an FPC connector constructed in accordance with a first embodiment of the present invention.
Figure 2:
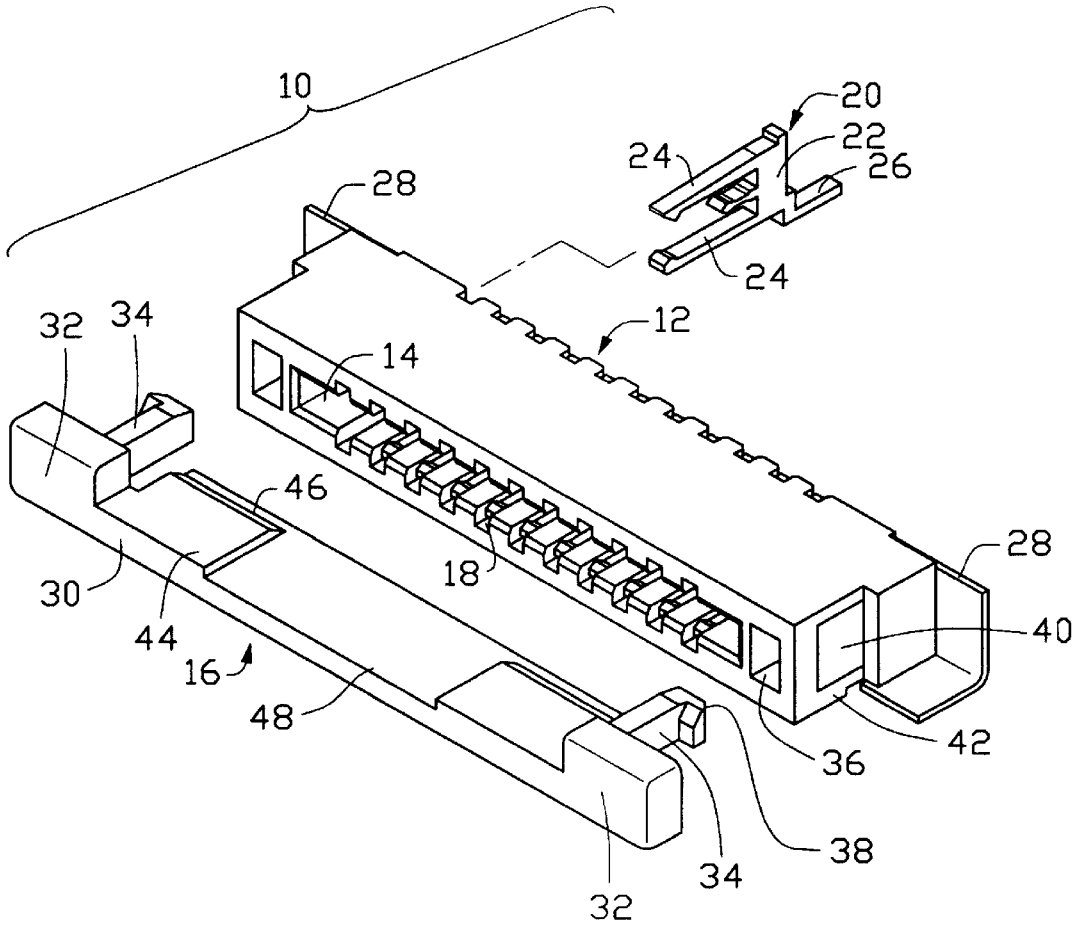
FIG. 2 is an exploded view of the FPC connector of FIG. 1.
Figure 3:
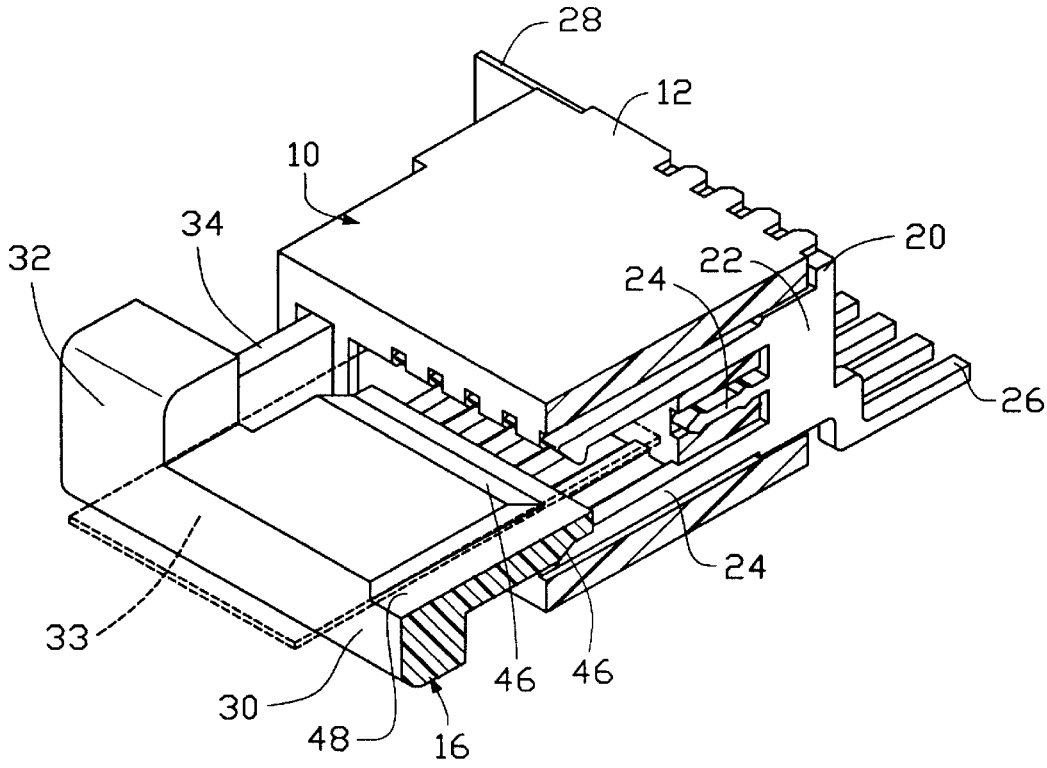
FIG. 3 is a cross-sectional view taken along line 3—3 of FIG. 1.

With reference to the drawings and in particular to FIGS. 1–3, an FPC (Flexible Printed Circuit) connector constructed in accordance with a first embodiment of the present invention, generally designated with reference numeral 10, comprises an insulative housing 12 defining a central slot 14 and a stuffer bar 16 movably received in the slot 14. The stuffer bar 16 is movable with respect to the housing 12 between a withdrawn position as shown in FIG. 1 and an engaged position where the stuffer bar 16 is moved further into the slot 14.

Passageways 18 are defined in the housing 12 for receiving and retaining conductive contacts 20. Each contact 20 comprises a base section 22 and two forward branches 24 extending from the base section 22 in a forward direction and a soldering tail 26 extending from the base section 22 in a rearward direction to be soldered to for example a mother board (not shown). The forward branches 24 of the contact 20 are spaced from each other and respectively accommodated in the passageways 18 on opposite sides of the central slot 14 with the stuffer bar 16 movable therebetween.

Housing retention members 28 are attached to opposite ends of the housing 12 for attaching the housing 12 to the mother board.

The stuffer bar 16 comprises a base 30 having two expanded ends 32 serving as finger grips to be gripped by a user's fingers (not shown) for manually moving the stuffer bar 16 between the withdrawn position and the engaged position. The expanded ends 32 also define a space therebetween for accommodating a flexible printed circuit 33 (FIG. 3). Two retention arms 34 extend from the expanded ends 32 of the stuffer bar 16 and received in bores 36 defined in opposite ends of the housing 12. Each retention arm 34 forms a sideway projection 38 received in a slot 40 defined in a corresponding end wall 42 of the housing 12 in communication with the bore 36. The slot 40, together with the sideway projection 38 of the retention arm 34, limits the movement of the stuffer bar 16 with respect to the housing 12 and prevent the stuffer bar 16 from undesired separation from the housing 12.

The base 30 has a flat surface 44 extending between the expanded ends 32 for supporting an edge of the flexible circuit 33. The flat surface 44 applies a force or pressure to the flexible circuit 33 for driving the flexible circuit 33 against the branches 24 of the contacts 20 thereby electrically engaging a conductive pattern (not shown) of the flexible circuit 33 with the contacts 20 when the stuffer bar 16 is moved to the engaged position. For facilitating movement of the stuffer bar 16 deeply into the slot 14 to the engaged position, inclined surfaces 46 are formed in a rearward side of the base 30.

A recess 48 is formed in a middle portion of the flat surface 44 of the base 30. With the recess 48, the middle portion of the flat surface 44 is free of pressure applied to the flexible circuit 33. Forces acting upon the flexible circuit 33 are provided by the flat surface 44 on opposite sides of the recess 48 and close to the finger grips 32. Moments induced by a driving force applied to the finger grips by the user are thus reduced. Damage to the stuffer bar 16 in withdrawing/inserting the stuffer bar 16 from/into the housing 12 can be effectively alleviated.

Figure 4:
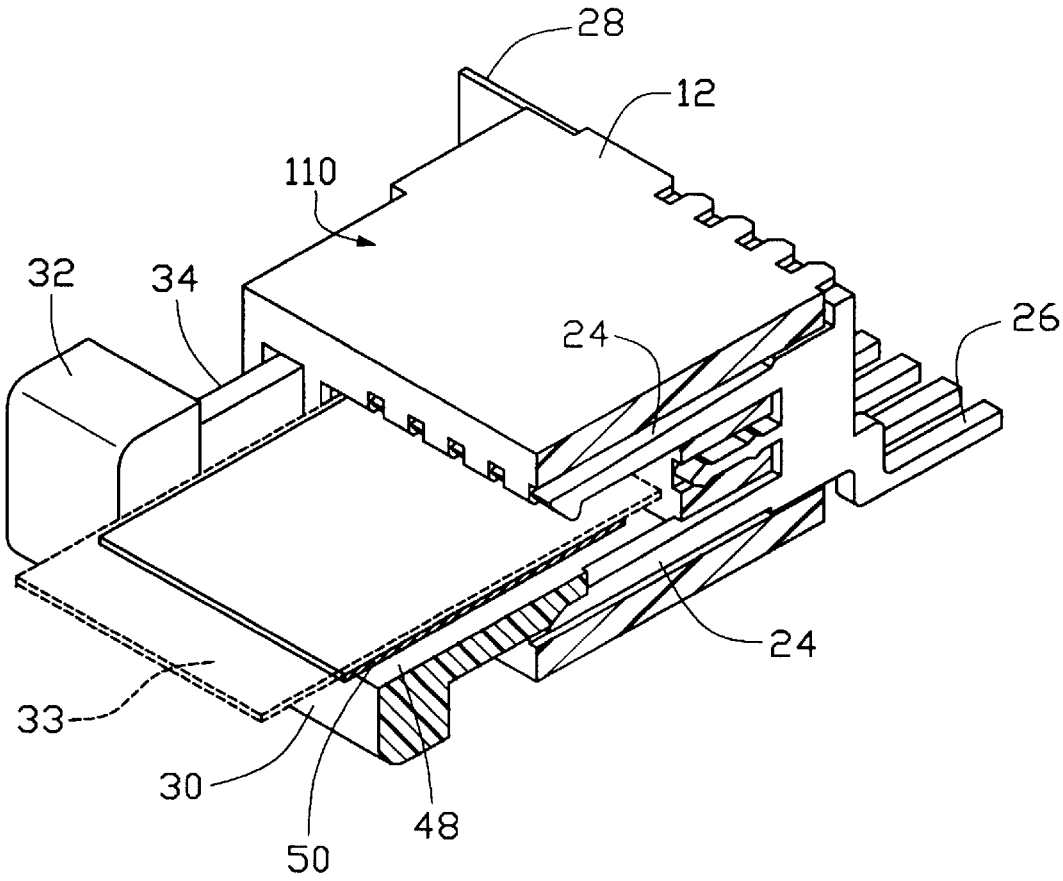
FIG. 4 is a cross-sectional view similar to FIG. 3, but showing a second embodiment of the FPC connector in accordance with the present invention.

FIG. 4 shows a second embodiment of the FPC connector in accordance with the present invention, generally designated with reference numeral 110. The FPC connector 110 is a modification of the FPC connector 10 discussed with reference to FIGS. 1–3. To simplify the description, corresponding parts in both connectors 10, 100 of the first and second embodiments are designated with the same reference numerals and will not be described again.

The FPC connector 110 further comprises a circuit support plate 50 received between the expanded ends 32 of the stuffer bar 16 and interposed between the flat surface 44 and the flexible circuit 33 for uniform distribution of the normal force applied by the stuffer bar 16 to the flexible circuit 33. The circuit support plate 50 is thin and rigid whereby the plate 50 can be readily interposed between the flexible circuit 33 and the stuffer bar 16 to uniformly distribute the force applied to the flexible circuit 33.

Figure 5:
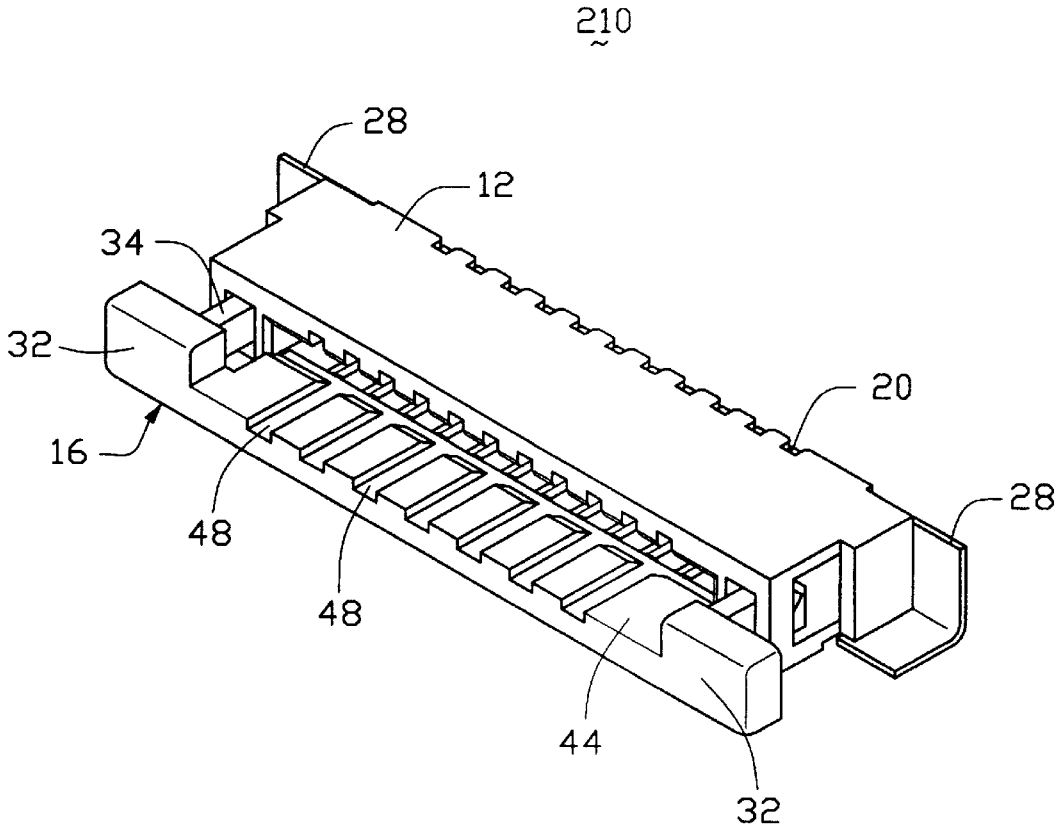
FIG. 5 is a perspective view of an FPC connector constructed in accordance with a third embodiment of the present invention.

A third embodiment of the FPC connector in accordance with the present invention is shown in FIG. 5 and generally designated with reference numeral 210. The FPC connector 210 of the third embodiment is in general a modification of the FPC connector 10 of the first embodiment discussed with reference to FIGS. 1–3. Thus, corresponding parts between the FPC connectors 10, 210 of the first and third embodiments are designated with the same numerals and the description thereof is omitted for simplicity. The only difference between the connectors 10, 210 is that instead of only one recess 48 defined in the flat surface 44 of the stuffer bar 16 as illustrated in the first embodiment 10, the flat surface 44 of the stuffer bar 16 of the FPC connector 210 defines a number of recesses 48 to achieve the same purposes. The recesses 48 can be identical and uniformly distributed. Alternatively, the recesses 48 can be of different sizes and/or distributed in an irregular fashion.

Apparently, the circuit support plate 50 of the second embodiment connector 110 can also be incorporated in the connector 210 of the third embodiment.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An electrical connector for electrically connecting a flexible circuit comprising:

an insulative housing defining a central slot;

a plurality of conductive contacts retained in the housing, each contact having two spaced portions located in the slot, the spaced portions defining a receiving room therebetween; and a stuffer bar movably received in the slot, the stuffer bar having a flat surface for carrying a flexible circuit into the receiving room and applying a normal force to the flexible circuit against the portions of the contacts and forming electrical engagement therebetween, wherein at least one recess is defined in the flat surface of the stuffer bar, a thin rigid plate interposed between the flat surface of the stuffer bar and the flexible circuit, wherein a number of recesses are defined in the flat surface of the stuffer bar.

* * * * *